United States Patent [19]

Clemmow

[11] 4,453,775

[45] Jun. 12, 1984

[54] CUTTING TOOL AND METHOD OF MANUFACTURING SUCH A TOOL

[75] Inventor: Raymond J. Clemmow, Sheffield, England

[73] Assignee: Padley & Venables Limited, Sheffield, England

[21] Appl. No.: 322,452

[22] Filed: Nov. 18, 1981

[30] Foreign Application Priority Data

Nov. 24, 1980 [GB] United Kingdom ..... 8037568

[51] Int. Cl.[3] ..... E21C 35/18; E21C 35/22

[52] U.S. Cl. ..... 299/81; 175/393; 175/410

[58] Field of Search ..... 299/81, 91, 17; 175/393, 410, 375, 339, 340, 374

[56] References Cited

U.S. PATENT DOCUMENTS

| | | | |
|---|---|---|---|
| 1,388,490 | 8/1921 | Suman | 175/393 |
| 1,477,932 | 12/1923 | Bashara | 175/393 X |
| 1,943,880 | 1/1934 | Rea | 175/393 X |
| 2,529,788 | 11/1950 | Signell | 175/393 X |
| 2,933,295 | 4/1960 | Rollins | 299/91 |
| 3,356,418 | 12/1967 | Healey | 299/91 |
| 3,603,414 | 9/1971 | Stebley | 175/410 X |
| 3,942,838 | 3/1976 | Bailey | 299/91 |
| 4,251,109 | 2/1981 | Roepke | 299/81 |

*Primary Examiner*—Ernest R. Purser
*Attorney, Agent, or Firm*—Harold W. Milton, Jr.

[57] ABSTRACT

A cutting tool and a method of manufacturing such a tool which may be a pick, bit or for a machine tool, in which a hard cutting insert 4 is mounted in a recess 7. Formed between the insert 4 and recess 7 are passages 11 which communicate with a fluid supply passage 13 and through which fluid for dust suppression, lubrication, cooling or removal of detritus is passed to emerge at ports 11*a* immediately adjacent to the cutting insert in the cutting region of the tool.

The insert 4 is preferably formed as a pressing or moulding to include channels which co-operate with opposed walls of the recess 7 to form the passages 11.

Preferably the insert 4 is secured in the recess 7 by press fitting and/or by heat shrinking the head 1 of the tool onto the recess to apply compressive retaining forces thereto.

In a modification the insert 4 is provided with a sleeve and such assembly is received in the recess 7. With an insert and sleeve assembly fluid passages can be formed in the sleeve; between the sleeve and the insert, or between the sleeve and the recess 7. The sleeve may provide a wedge between the insert 4 and the recess 7 for retention of the insert in the recess.

25 Claims, 9 Drawing Figures

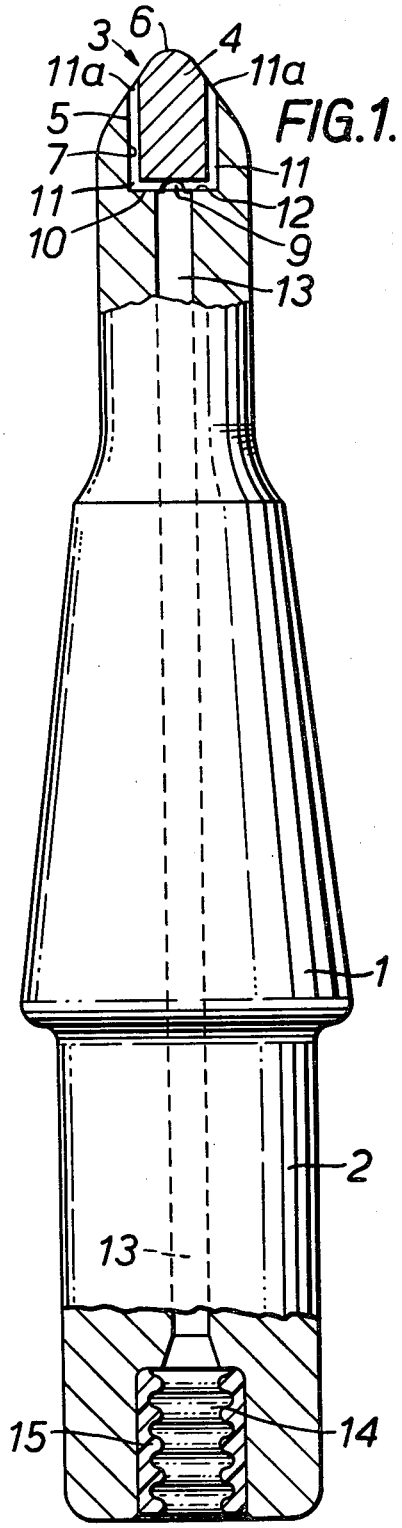
FIG.1.
FIG.2.
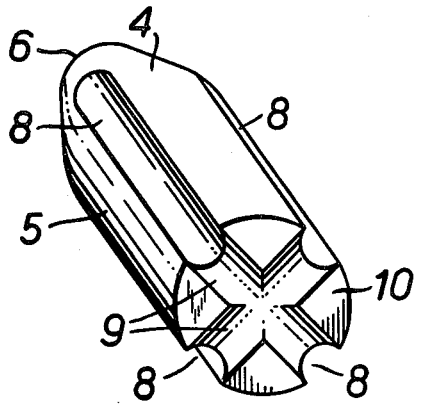
FIG.3.
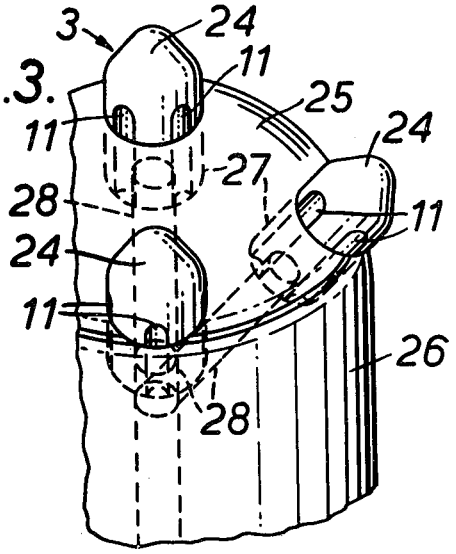

CUTTING TOOL AND METHOD OF MANUFACTURING SUCH A TOOL

DESCRIPTION

This invention relates to a cutting tool and to a method of manufacturing such a tool.

More particularly, the invention concerns a cutting tool such as a rock, mineral mining or road planing pick, a drill bit of the rotary and/or percussive type, or a cutting tool for a machine tool such as a lathe, miller or planer in which a body of the tool has a head and at least one cutting insert part comprising a hard material (such as tungsten carbide or a ceramic) component, said insert part being mounted in a recess in the head to provide a cutting tip in the cutting region of the tool; such a tool will hereinafter be referred to as "of the kind specified".

When using cutting tools of the kind specified it is known for purposes of dust suppression, cooling, lubrication and/or removal of detritus and the like to provide passages through which "flushing" fluid is directed to the cutting region. In conventional drill bit structures these passages are formed by holes drilled in the tool body to emerge therefrom in wings or flutes of the bit; with machine tools the passages usually comprise pipes situated remotely from the cutting tool and with picks the passages may be formed in a block, drum or other form of holder within which the pick is held, for example as discussed in our British Patent Application No. 42904/76. For efficient usage of the fluid, which may be a liquid or gas, it is essential that the flow is accurately directed, usually over the cutting tip or tips of the tool in the cutting region and it is an object of the present invention to provide a cutting tool of the kind specified by which this can be achieved simply and efficiently from within the body of the tool.

According to the present invention there is provided a cutting tool of the kind specified in which the or at least one cutting insert part at least partly defines externally of the hard material component an egress passage in a peripheral region thereof, said egress passage being provided for directing fluid into the cutting region of the tool and communicating with a fluid supply passage in the tool body.

Further according to the present invention there is provided a cutting tool as specified in the immediately preceding paragraph in combination with a tool holder by which the tool is supported for cutting with its fluid supply passage communicating with a source of fluid under pressure.

Still further according to the present invention there is provided a method of manufacturing a cutting tool of the kind specified which comprises forming the tool body with the recess for receiving the cutting insert part and with a fluid supply passage communicating with the recess; providing the cutting insert part with means which at least partly defines an egress passage externally of the hard material component and in a peripheral region of the insert part, mounting the insert part in the recess to provide said egress passage in communication with the supply passage for directing fluid into the cutting region of the tool.

By the present invention the cutting insert part or one or more such insert parts of the cutting tool can have associated therewith one or more egress passages through which fluid (sometimes referred to as "flushing fluid" although this may be liquid or a gas which is used for flushing, lubricating, cooling, dust suppressing or otherwise) is directed into the cutting region adjacent to the hard material component of the respective insert part or parts; in this way flushing fluid may be arranged to flow immediately over the cutting tip or one or more of the cutting tips of the tool to provide efficient use of the fluid whether it be for dust suppression, cooling, lubrication or detritus removal. Furthermore, by providing one or more egress passages with outlet ports immediately adjacent to the hard material component of the insert part or parts it is believed possible that high pressure fluid such as water can be directed through those passages to such an extent that the fluid itself provides a cutting, shattering or breaking effect on the workface. It is believed that these desirable features of the invention will effectively prolong the working life of the cutting tool in comparison with known cutting tools of a similar nature without the egress passage or passages.

The cutting insert part may consist of the hard material component or be an assembly comprising the hard material component and seating means with which the component is mounted in the recess. As an assembly the insert part may comprise, for example, the component and a plate on which the component is seated in the recess of a cutting tool for a machine tool or the component and a sleeve within which the component is received and mounted in the recess of a cutting tool in the form of a pick or drill bit. The egress passage is located in the peripheral region of the insert part and externally of the hard material component so that the bulk of the hard material component will be solid and thereby not unduly weakened and susceptible to fracture (as would be the case if holes or other fluid passages are formed within the component). Having this latter important point in mind an egress passage (or part length thereof may be formed by a bore extending through the seating means; alternatively or in addition an egress passage (or part length thereof) may be formed by a groove or channel which is closed by a face which opposes it.

By one embodiment of the present invention an insert part consisting of a hard material component can have one or more egress passages associated therewith and formed between the periphery of the component and the opposing wall of the recess within or on which the component is mounted. Such an egress passage may be formed by providing a groove or channel in a face or wall of either the component or the recess and which groove or channel is closed to form the passage by the opposing face or wall of either the recess of the component as the case may be. Although such a groove or channel can be formed in the wall of the recess it may require relatively expensive machining of the tool body. It is preferred therefore that the groove or channel is provided in the periphery of the hard material component so that such channel is closed to form an egress passage by a substantially uninterrupted face or wall of the recess. This latter preference is particularly relevant where the component is formed as a moulding or pressing of the hard material such as tungsten carbide and the groove or channel results directly from the forming operation; such integral forming of the groove or channel with the moulding or pressing is easily achieved by use of appropriately shaped dies with little, if any, additional expense in comparison with the cost of forming conventionally shaped moulded or pressed inserts.

By further embodiments of the present invention an insert part comprising the assembly of a hard material component and seating means for such component can have one or more egress passages associated therewith and formed between the said component and the seating means or between the seating means and the opposing wall of the recess within or on which the insert part is mounted. Such an egress passage may conveniently be formed by providing a groove or channel in a face or wall of the seating means so that the groove or channel is closed to form the passage by the opposing face or wall of either the component or the recess. This latter technique of passage formation may be preferable in cases where it is desirable to avoid structural irregularities (as would be effected by grooves or channels) in the surface of the hard material component, for example to facilitate machining of the hard material component; furthermore it is likely in certain instances to prove more convenient and simpler to form grooves or channels in the seating means than in either the component or the wall of the recess.

In many of the pick and bit applications for the cutting tool the insert part will have a generally cylindrical or frusto conical shape and be mounted by insertion axially into a substantially complementary shaped recess and in such case one or more axially extending egress passages can be provided. With this arrangement (as with non-cylindrically or frusto conically shaped recesses within which the insert part may be housed) it is convenient for the fluid supply passage to open into the bottom portion of the recess and it must of course be ensured that such passage can communicate with the or each egress passage; to provide and maintain such communication the egress passages can effectively be extended by grooves or channels over a bottom (possibly radial) face of the insert part at the inner end thereof. In this way adequate non-grooved or non-channelled material of the insert part can be retained on its bottom (inner end) face to provide a sufficient load bearing area for the hard material component on the bottom of the recess. It will be apparent that the insert part can be of any desired shape for accommodation in an appropriately shaped recess provided that fluid communication is maintained between the egress and supply passages.

The insert part can be retained in co-operation with its associated recess by any convenient means provided that such means does not obturate either the egress passage or the fluid supply passage (or the communication between those passages). Clamping of the insert part to the tool body or a recessed shoulder thereof is a possibility in machine tool applications. An insert part can be retained in its associated recess and/or a hard material component can be retained with its associated seating means for example by a brazing technique, by an interference or press fit technique or by use of a thermal contraction technique (shrink fitting) as is well known in the art of rotary/percussive drill bits. By this latter technique the insert part can be located in its recess with the tool body hot so that as the body cools it shrinks onto the insert part and subjects it to compressive retention forces. Frequently the insert part will be secured in its recess by a combination of press and shrink fitting techniques a similar means of retention may be used for securing the hard material component in a sleeve-like seating means. A further technique by which the hard material component can be secured in the recess is by use of the seating means as a wedge between that component and an opposing wall of the recess.

Usually the cutting tool will include a shank which is formed as part of the body and serves for mounting the tool in an appropriate holder. Conveniently the fluid supply passage extends through the shank for coupling to an appropriate fluid supply for which purpose the shank may carry sealing means for effecting a fluid seal with the fluid supply. Coupling of the shank or tool generally to the fluid supply can be effected by any convenient arrangement such as by a mating socket and tubular spigot joint. Although it is preferred that a single fluid supply inlet is provided on the cutting tool it will be appreciated that the fluid supply passage may branch to communicate with respective egress passages associated with different cutting insert parts as may be provided on the tool.

Embodiments of cutting tools constructed in accordance with the present invention will now be described, by way of example only, with reference to the accompanying illustrative drawings in which:

FIG. 1 is a side elevation, in part section, of a neavy duty pick as may be used for rock or mineral mining or road planing and in which the cutting insert part consists of a hard material component;

FIG. 2 is a perspective view of the hard material component which is incorporated in the pick of FIG. 1;

FIG. 3 is a perspective view of part of a rotary percussive-type drill bit and shows an array of stud insert parts mounted in the head of the bit in a similar manner to that shown in FIG. 1;

Figure 6:
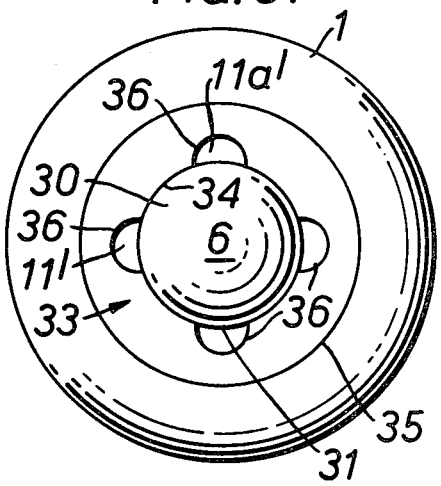
FIG. 6 is an end view of the insert part incorporated in the pick of FIG. 5.
Figure 5:
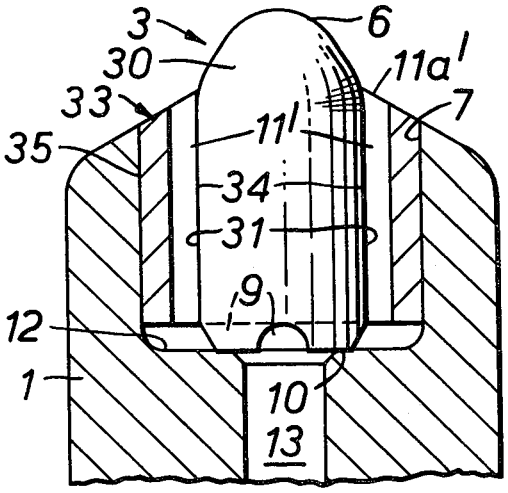
FIG. 5 is a side elevation, in part section, of the cutting region of a pick in which the insert part is an assembly of a hard material component and seating means in the form of a sleeve within which that component is received.
Figure 7:
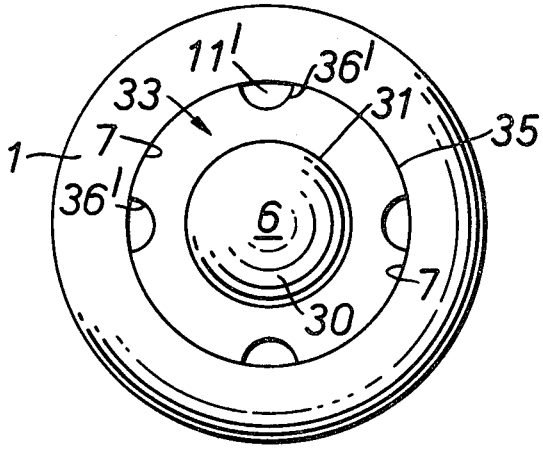
Figure 8:
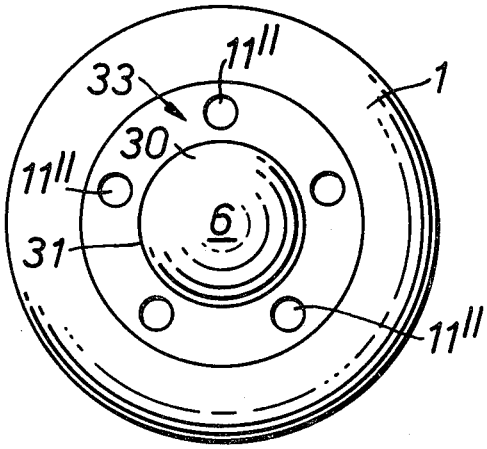
Figure 9:
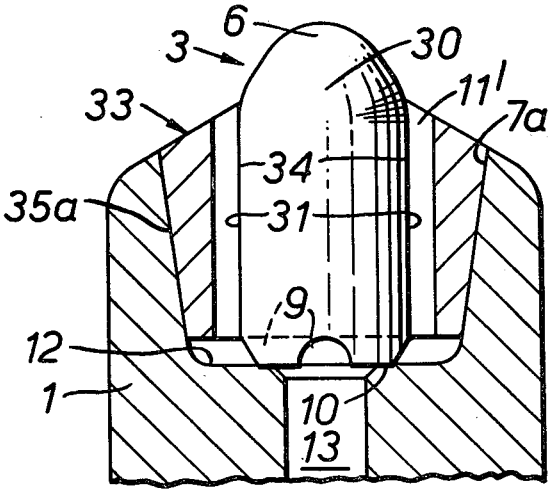

FIGS. 7 and 8 are end views of modified insert parts which are assembled from hard material components and sleeves similarly to that shown in FIG. 6 but in which the egress passages are formed differently, and FIG. 9 is a view of a pick similar to that shown in FIG. 5 where the insert part is an assembly but in which the sleeve forms a wedge for retention of the hard material component in the recess.

The cutting tool in FIG. 1, which is conveniently shown as a point-attack pick, has a one piece steel body comprising a head 1 and a shank 2. Located in the cutting region 3 of the pick is a cutting insert part consisting of a hard material (for example tungsten carbide) component 4 which (see FIG. 2) has a generally cylindrical profile 5 tapering to a cutting tip 6. The component 4 is mounted and secured in a substantially complementary cylindrical recess 7 in the head 1 so that the cutting tip 6 is presented for use in conventional manner.

As shown in FIG. 2 the cylindrical face of the component 4 is provided with a peripherally spaced array of four axially extending grooves 8. These grooves 8 communicate with cross grooves 9 in the radially extending bottom or inner end face 10 of the component remote from its tip 6. When the component 4 is positioned in the recess 7 the grooves 8 and 9 form with the opposed walls of the recess a spaced array of egress passages 11 having outlet ports 11*a* in the peripheral region of the insert part 4. As will be apparent from FIG. 1 the grooves 8 are closed to form passages by the cylindrical face of the recess 7 while the grooves 9 are closed to form extensions to the first mentioned passages by a flat bottom face 12 of the recess. The end face 10 is seated on the bottom face 12 in substantially face-to-face abutment to provide support for the component 4.

Extending through the shank and head parts of the tool body is a substantially straight supply passage 13 which opens into the bottom portion of the recess 7 at the centre of the bottom face 12 to communicate with the egress passages 11 at the junction of the cross groove 9. The supply passage 13, which is conveniently formed by drilling, communicates between the egress passages 11 and a socket 14 by which the passage is intended to be coupled (by a tubular spigot (not shown) received in the socket 14) to a source of fluid under pressure. To provide efficient coupling between the tubular spigot and the socket 14 the latter houses a plastics or rubber sleeve 15 within which the spigot is received and which sleeve is deformable between the socket and spigot to provide a fluid seal engagement.

In rock and mineral mining applications water is usually used as a flushing and dust suppression fluid and in use of the pick shown in FIG. 1 the shank 2 will be mounted in a pick block or other holder so that the supply passage 13 communicates with a source of water under pressure. Flushing water flows through the passage 13 and into the egress passages 11 from which it emerges at the ports 11*a* immediately adjacent to the cutting insert part 4 to be directed into the cutting region 3 for flow over the tip 6.

Although the component 4 (see FIG. 2) is of unconventional form it is nonetheless easy to manufacture as compared with conventionally shaped cutting inserts of tungsten carbide or other hard material compositions capable of being shaped by known moulding or pressing techniques (where the shape is primarily dependent upon the form of the dies within which the moulding or pressing is effected and the grooves 8 and 9 can thereby be formed integral with the moulding or pressing).

The component 4 may be secured in the recess 7 by a combination of heat shrinkage and press fitting techniques whereby the head 1 is heated sufficiently to expand the recess 7 to receive the insert part 4 which is press fitted into the recess following which the head is cooled to contract and apply compressive forces to the insert part for retaining it in the recess.

The rotary percussive drill bit shown in FIG. 3 has an array of stud-like hard material components 24 mounted in the working face 25 of its head 26 and is generally known as a "button-bit" where each component 24 may be generally cylindrical and formed in a similar manner to that shown in FIG. 2, some of the components being located in recesses in the head 26 with their axes parallel to the axis of the drill bit and some with their axes inclined to the axis of the drill bit. Each of the components 24 is mounted in a respective cylindrical recess 27 in a similar manner to the arrangement described with reference to FIGS. 1 and 2 to provide egress passages 11 which communicate in the bottom portion of the respective recesses 27 with a respective supply passage 28. In the FIG. 3 embodiment the supply passage is branched to each of the components 24 or to each of selected components and these branches converge to communicate with a common passage extending axially through the bit shank to receive flushing fluid through the drill string or drill rods in conventional manner.

The hard material components 4 and 24 in the embodiments of FIGS. 1 to 3 each have their cylindrical faces 5 interrupted by the grooves 8; these grooves may inconvenience machining of the components preparatory to fitting the components into their respective recesses in the tool body. To alleviate this possible inconvenience the hard material components shown at 30 which are incorporated in the embodiments of the picks in FIGS. 4 to 9 each have a continuous cylindrical surface 31 tapering to the cutting tip 6 while the cross grooves 9 are provided in the inner end face 10 of the insert (that is the components 30 are similar to the component 4 in FIG. 2 without the grooves 8).

Figure 4:
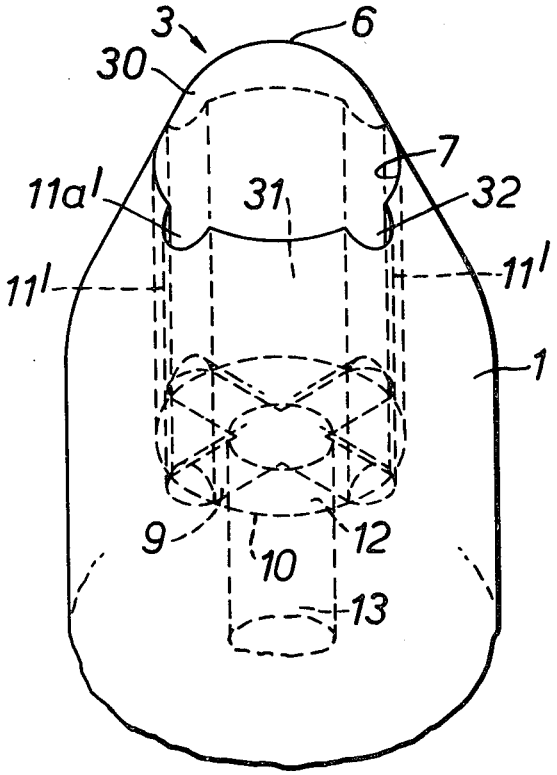
FIG. 4 is a perspective view of the cutting region of a heavy duty pick similar to that shown in FIG. 1 and illustrates a further technique by which egress passages can be formed by an insert part which consists of a hard material component.

In the embodiment of FIG. 4 the insert part consisting of the component 30 defines with its recess 7 egress passages 11′ which open at outlet ports 11*a*′ in the peripheral region of the insert part 30. The passages 11′ are formed by a circumferentially spaced array of axially extending channels 32 machined in the cylindrical face of the recess 7 and which channels are closed by the opposing cylindrical face 31 of the insert 30. The egress passages 11′ are extended to communicate with the supply passage 13 by the cross grooves 9 in the bottom face of the insert 30. It is important that the passages 11′ maintain communication with the passage 13 through the grooves 9 and to achieve this the diameter of the recess 7 at the inner end thereof adjacent to its bottom face 12 may be slightly enlarged to provide a chamber (not shown) which is in constant communication with the cross grooves 9 and also with the channels 32 so that fluid communication is maintained between these grooves and channels irrespective of the relative axial orientation between them. Preferably the insert 30 is secured in the head 1 by a press and shrink fitting technique.

The embodiments of FIGS. 5 to 9 each have their cutting insert part formed as an assembly comprising the hard material component 30 and a seating in the form of a steel sleeve 33 within which the component 30 is received and mounted in its recess in the head 1.

The sleeve 33 of the cutting insert part assembly of FIGS. 5 and 6 has generally cylindrical and coaxial inner and outer surfaces 34 and 35 respectively within the former of which the cylindrical profile 31 of the component 30 is received and the latter of which is received in the cylindrical recess 7, both in substantially complementary manner. As shown in FIG. 6 the cylindrical sleeve 33 is provided in its inner surface 34 with a circumferentially spaced array of axially extending machined channels 36. These channels 36 are closed by the opposing cylindrical surface 31 of the component 30 to form the egress passages 11′ which open to the ports 11*a*′ at the periphery of the component 30 and externally thereof. Similarly to the embodiment of FIG. 4 the passages 11′ are extended to communicate with the supply passage 13 through the cross grooves 9 with which they are in constant communication. The formation of the channels 36 is a relatively simple machining operation and the sleeve can be secured to the component 30 by a press/shrink fitting technique to ensure that the egress passages are not obturated. The insert part assembly 30, 33 in FIGS. 5 and 6 can similarly be mounted and secured in the recess 7 by a press/shrink fitting technique or by a brazing or similar technique as there are no passages to be obturated between the opposing cylindrical surfaces 7 and 35.

The arrangement shown in FIG. 7 is similar to that shown in FIGS. 5 and 6 with the exception that axially extending channels 36′ for forming the egress passages are located in the external cylindrical surface of the sleeve. These channels 36′ are closed to define part lengths of the egress passages 11′ by the opposing cylindrical surface 7 of the recess. In this case the component 30 can be secured to the cylindrical sleeve by any convenient means such as press/-shrink fitting or brazing techniques while the insert part assembly can be mounted and secured in the head 1 by press/shrink fitting the assembly within the recess 7.

In the embodiment of FIG. 8 the egress passages which emerge in the peripheral region of the component 30 are partly formed by a circumferentially spaced array of axially extending bores 11″ which are in constant communication with the cross grooves 9 in a similar manner to the arrangement shown in FIG. 5. In this case the component 30 can be secured to the inner cylindrical surface of the sleeve 33 and the sleeve 33 can be mounted and secured in the cylindrical recess 7 by brazing, press fit or shrink fit techniques.

The sleeve 33 in the cutting insert part assembly of FIG. 9 is generally of wedge shape having the cylindrical inner surface 34 and a concentric frusto conical outer surface 35*a*. The wedge shaped sleeve 33 is received in the recess of the head 1 which recess is of frusto conical shape as indicated at 7*a* to be complementary to the surface 35*a*. The sleeve 33 in FIG. 9 defines(-wholly or in part) part length of the egress passages 11′ in a similar manner to that discussed above with reference to FIGS. 4 to 7 (the egress passage formation shown in FIG. 9 is conveniently that as discussed with reference to FIG. 6). The cutting insert part assembly of FIG. 9 is mounted as a press (possibly shrink) fit within the recess 7*a* so that the sleeve 33 forms a wedge between the component 30 and the head 1. To provide appropriate wedging action whereby radial compression is applied to the component 30 from the sleeve 33, the latter may be split axially so that it is, for example, a one piece component of generally "C" section in axial end view.

I claim:

1. A mineral mining pick assembly comprising: a body with a head; a cutting insert part including a hard material component; a recess in said head having a bottom wall and a continuous axially extending peripheral surface, said insert part having a cutting tip and a bottom end, said insert part mounted in said recess with said bottom end abutting and supported on said bottom wall of said recess, said insert part having an outer surface press or shrink fitted and retained in said recess by compressive retaining forces of said peripheral surface in said recess acting radially upon said insert part, said fit between said recess and said insert part being sufficiently tight to provide a fluid seal therebetween and to retain said insert part therein in response to repeated impact upon said cutting tips, said cutting insert part at least partly defining externally of the hard material component a plurality of spaced egress passages in a peripheral region thereof extending from said bottom end to said cutting tip, said egress passages communicating with a plurality of outlet ports through which fluid is directed onto the cutting tip thereof; said body having a fluid supply passage communicating with said recess through said bottom wall thereof; and extension egress passage means in said recess communicating between said fluid supply passage and said egress passages, said extension egress passage means being external of said insert part and extending radially between said insert part and said bottom wall to said egress passages while allowing the bottom end of said insert part to react with the bottom of the recess in response to impact upon said cutting tip.

2. A cutting tool as claimed in claim 1 in which said extension egress passage means comprises groove means between said insert part and said bottom wall.

3. A cutting tool as claimed in claim 1 in which said extension egress passage means is formed between a channel in said insert part and said bottom wall which closes said channel.

4. A cutting tool as claimed in claim 1 in which the insert part is an assembly comprising the hard material component and seating means with which the component is mounted in the recess.

5. A cutting tool as claimed in claim 4 in which the egress passage is formed, at least partly, by a bore extending through the seating means.

6. A cutting tool as claimed in claim 4 in which the seating means is received in the recess as a wedge between the component and an opposing wall of said recess.

7. A cutting tool as claimed in claim 4 in which the seating means comprises a sleeve within which the component is received and said component is retained in the sleeve by at least one of a press or interference fit, heat shrinkage or brazing techniques.

8. A cutting tool as claimed in claim 1 in which the egress passage is formed at least partly by a channel which is closed by a face which opposes it.

9. A cutting tool as claimed in claim 8 in which the channel is located in the insert part.

10. A cutting tool as claimed in claim 9 in which the egress passage is formed, at least partly, between the periphery of the insert part and an opposing wall of the recess.

11. A cutting tool as claimed in claim 9 in which the insert part is an assembly comprising the hard material component and seating means with which the component is mounted in the recess and the egress passage is formed, at least partly, between the component and the seating means.

12. A cutting tool as claimed in claim 11 in which the channel is located, at least partly, in the seating means.

13. A cutting tool as claimed in claim 1 in which the component comprises a pressing or moulding of hard material composition and the egress passage is formed, at least partly, integral with said pressing or moulding.

14. A cutting tool as claimed in claim 1 in which the recess is substantially cylindrical.

15. A cutting tool as claimed in claim 1 in which the recess is substantially frusto conical with its larger diameter end opening from the tool body.

16. A cutting tool as claimed in claim 1 in which the insert part is an assembly comprising the hard material component and seating means with which the component is mounted in the recess and wherein the seating means is located between the axially extending surface of the recess and the opposed surface of the component.

17. A cutting tool as claimed in claim 16 in which the seating means comprises an axially extending sleeve within which part length of the component is received.

18. A cutting tool as claimed in claim 17 in which the sleeve receives the component in substantially complementary manner and is substantially complementarily received in the recess.

19. A cutting tool as claimed in claim 17 in which the sleeve has an axially extending split.

20. A cutting tool as claimed in claim 1 in which the insert part is retained in its recess by a heat shrinkage technique whereby the insert part is subjected to compressive retaining forces.

21. A cutting tool as claimed in claim 1 in which the insert part is retained in its recess by a brazing technique.

22. A cutting tool as claimed in claim 1 in which the tool body has a shank through which the fluid supply passage extends for coupling to a fluid supply.

23. A cutting tool as claimed in claim 22 in which the shank carries sealing means by which a fluid seal is effected when the supply passage is coupled to the fluid supply.

24. A cutting tool as claimed in claim 1 and in combination with a tool holder by which the tool is supported for cutting with its fluid supply passage communicating with a source of fluid under pressure.

25. The combination as claimed in claim 24 in which a socket and spigot coupling is provided between the cutting tool and its holder and said coupling effects communication between the supply passage in the tool body and the source of fluid.

* * * * *